US006565957B2

(12) United States Patent
Nakamura et al.

(10) Patent No.: US 6,565,957 B2
(45) Date of Patent: May 20, 2003

(54) COATED CUTTING TOOL

(75) Inventors: Eiji Nakamura, Ohmiya (JP); Takatoshi Ohshika, Ohmiya (JP); Yasuhiko Tashiro, Ohmiya (JP); Toshiaki Ueda, Ohmiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/820,838

(22) Filed: Mar. 30, 2001

(65) Prior Publication Data

US 2002/0028323 A1 Mar. 7, 2002

(30) Foreign Application Priority Data

| | | |
|---|---|---|
| Dec. 22, 2000 | (JP) | 2000-390038 |
| Dec. 22, 2000 | (JP) | 2000-390039 |
| Dec. 22, 2000 | (JP) | 2000-390040 |
| Feb. 28, 2001 | (JP) | 2001-054097 |
| Feb. 28, 2001 | (JP) | 2001-054098 |

(51) Int. Cl.[7] ..... B23P 15/28

(52) U.S. Cl. ..... 428/216; 51/307; 51/309; 428/336; 428/697; 428/698; 428/699; 428/701

(58) Field of Search ..... 428/698, 699, 428/697, 701, 216, 336; 51/307, 309

(56) References Cited

U.S. PATENT DOCUMENTS

| | | | | |
|---|---|---|---|---|
| 4,619,866 | A | | 10/1986 | Smith et al. |
| 5,372,873 | A | | 12/1994 | Yoshimura et al. |
| 5,549,975 | A | | 8/1996 | Schulz et al. |
| 5,624,766 | A | * | 4/1997 | Moriguchi et al. |
| 5,722,803 | A | | 3/1998 | Battaglia et al. |
| 5,770,261 | A | | 6/1998 | Nakamura et al. |
| 5,879,823 | A | | 3/1999 | Prizzi et al. |
| 5,882,777 | A | * | 3/1999 | Kukino et al. |
| 5,985,427 | A | | 11/1999 | Ueda et al. |
| 6,254,984 | B1 | * | 7/2001 | Iyori |
| 6,395,379 | B1 | * | 5/2002 | Braendle |

FOREIGN PATENT DOCUMENTS

| | | |
|---|---|---|
| JP | 3-122280 | 5/1991 |
| JP | 7-41963 | 2/1995 |
| JP | 8-3750 | 1/1996 |
| JP | 8-60340 | 3/1996 |
| JP | 9-125249 | 5/1997 |

* cited by examiner

*Primary Examiner*—Archene Turner
(74) *Attorney, Agent, or Firm*—Oblon, Spivak, McClelland, Maier & Neustadt, P.C.

(57) ABSTRACT

A coated cutting tool has high wear resistance in a high-speed cutting operation of steel. The tool is made of a hard sintered substrate and has a hard coating layer deposited on a surface of the substrate. This hard coating layer includes a hard material layer and an inner layer having 0.1 to 10 $\mu$m for an average thickness with residual compressive stress. The inner layer is applied by physical vapor deposition. The hard coating layer also has an aluminum oxide layer as an outer layer having 0.1 to 5 $\mu$m for an average thickness. This outer layer is applied by chemical vapor deposition at a middle temperature.

20 Claims, 2 Drawing Sheets

COATED CUTTING TOOL

CROSS REFERENCE TO RELATED APPLICATION

This application claims priority under 35 U.S.C. §119 from Japanese Patent Application Nos. 2000-390 038, 390 039 and 390 040, all filed on Dec. 22, 2000, and 2001-054 097 and 054 098, both filed on Feb. 28, 2001, which are incorporated herein by reference in their entirety.

BACKGROUND OF THE INVENTION

1. Field of the Invention

The present invention relates to a coated cutting tool in which a hard coating layer has excellent strength and hardness at high temperature. Therefore, it has high wear resistance even when it is applied to a high-speed cutting operation of ferrous materials such as steel and cast iron.

2. Discussion of the Background

Many kinds of conventional cutting tools are known. Throw-away inserts are used in various cutting operations such as turning or milling of steels and cast irons by flexibly attaching on bite holders, face milling cutter bodies and end-milling cutter bodies. Twist drills that are used for a drilling of the above-mentioned work materials are also well known. Recently, micro drills are extensively used in a drilling process of printed circuit boards. Furthermore, solid end-milling cutters, used in various operations such as face milling, groove milling and shoulder milling, are also widely used, for example, in mold machining processes.

Furthermore, in general, as a material constituting the above-mentioned putting tools, a coated cutting tool which comprises a hard coating, such as titanium nitride (hereinafter referred to as TiN), and/or titanium carbonitride (hereinafter referred to as TiCN), having 0.5–10 $\mu$m for the average layer thickness, on the surface of a hard material substrate, such as tungsten carbide-based cemented carbide (hereinafter referred to as cemented carbide), titanium carbonitride-based cermet (hereinafter referred to as cermet) and a high speed steel, is well known, and it is also known that said coated cutting tool is used for continuous cutting and to interrupt cutting of steels and cast irons.

As one of the hard coating layers of the above-mentioned coated cutting tool, according to Japanese Patent Laid Open Application No. 62-56565, it is known that a titanium-aluminum nitride [(Ti, Al) N] layer is coated under the following conditions, that is, for example, at first, in a condition of about 3 Pa and 500° C. inside the chamber, an arc discharge is generated between an anode electrode and a cathode electrode (an evaporation source) in which an Ti—Al alloy having predetermined composition is set, by loading electrical potential of 35V and electrical current of 90A, and after that, nitrogen gas is introduced as a reaction gas into the chamber, and the bias potential of, for example 200V, is applied to the substrate, by using an arc ion plating system which is one of the physical vapor deposition processes having equipment shown in FIG. 1.

Moreover, it is known that the residual compressive stress is given to the hard coating deposited by the physical vapor deposition process in this way, and the value of said compressive stress can be changed by selecting the coating conditions, such as the above-mentioned bias potential. It is also well known that the resistance against breakage, in other words, toughness, of said coated cutting tool can be raised by controlling this compressive stress suitably.

In addition, according to Japanese Patent Laid Open Application No. 1-240215, it is also known that other composite hard coatings, such as a composite nitride of titanium and zirconium [hereinafter referred to as (Ti, Zr)N] can be formed by utilizing another metal alloy target such as a Ti—Zr alloy as the evaporation source instead of above-mentioned Ti—Al alloy. These hard coatings can also raise the resistance against breakage of the coated cutting tool by suitably controlling the residual compressive stress of the coating like said (Ti, Al)N layer.

In recent years, there has been an increasing demand for labor-saving, less time-consuming cutting operations. Accordingly, there is a tendency that the condition of the cutting operation has changed to the severe side, such as high speed, along with the improvement of the performance of a cutting machine. With regard to various kinds of coated cutting tools conventionally proposed, as far as they are used in cutting operations of steel or cast iron using the usual cutting conditions, it has almost no problem. However, when they are used in high speed cutting operations, the hardness of these tools, especially at cutting edges, falls remarkably due to the extremely high heat generated. Therefore, thermal plastic deformation along the edge line occurs, and it promotes the severe wear of the cutting edge. As a result, the tool life becomes comparatively short.

SUMMARY OF THE INVENTION

Accordingly, the object of this invention provides for a coated cutting tool which has excellent strength and hardness at high temperatures and resists thermal plastic deformation at its cutting edge for a long period of time even when the machining process is performed under the severe conditions such as high speed cutting operations of, for example, steels and cast irons which conditions are accompanied by a high heat evolution.

The object of the present invention has been satisfied by the discovery of a coated cutting tool whose hard sintered substrate is coated with a hard coating layer preferably comprising an inner hard layer deposited by physical vapor deposition and has residual compressive stress, and an outer $Al_2O_3$ layer deposited by chemical vapor deposition at a middle temperature, for example, 700–850° C. This coated cutting tool gives excellent wear resistance even at the high speed cutting operations and enables the prolongation of tool life. Thus, they can respond sufficiently satisfactorily to the labor-saving and energy-saving of the cutting operations.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
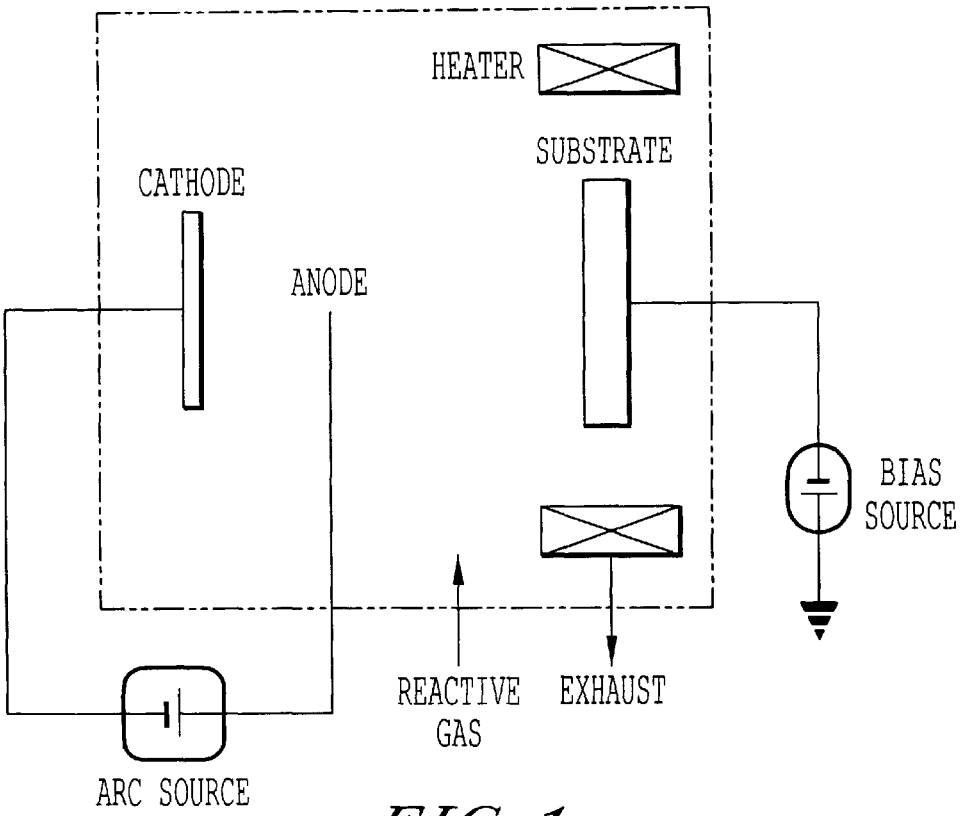
FIG. 1 shows an explanatory drawing of the arc ion plating equipment.

Reference is now made to the drawings, wherein like reference numerals designate identical or corresponding parts throughout the several views.

The present invention provides for a coated cutting tool having a cutting tool member that is coated with a hard coating layer. A "cutting tool member" refers to the part of the cutting tool that actually cuts the work piece. Cutting tool members include exchangeable cutting inserts to be mounted on bit holders of turning tools, face milling cutter bodies, and end-milling cutter bodies. They also include a cutting blade of drills and end mills. The cutting tool member is preferably made of a hard sintered substrate such as tungsten carbide-based cemented carbide.

A hard coating layer coats preferably a part of the surface, more preferably the entire surface of the cutting tool member. The hard coating layer is preferably made of an inner hard layer deposited by physical vapor deposition and has residual compressive stress, and an outer $Al_2O_3$ layer deposited by chemical vapor deposition at a middle temperature, for example, 700–850° C.

The preferred embodiments of the present invention were discovered after testing many different kinds of hard coating layers on hard sintered substrates such as cemented carbide, from the standpoint of developing a novel long lifetime coated cutting tool, which has high strength and high hardness even at high temperature. From these tests, the following results (A) to (C) were found:

(A) Although the hard coating layer such as a TiN layer or a (Ti, Al) N layer having a compressive stress deposited by physical vapor deposition has an excellent high temperature strength, it cannot maintain sufficient high temperature hardness if it is used at high speed cutting operations because the cutting edge is exposed to severe heat.

(B) A coated cutting tool with a hard coating layer has the above-mentioned hard inner layer having compressive stress deposited by physical vapor deposition, and an aluminum oxide (hereinafter referred to as $Al_2O_3$) outer layer deposited on said inner layer by chemical vapor deposition, and demonstrates high wear resistance and long tool life even when it is applied to a high speed cutting operation, because the above-mentioned $Al_2O_3$ has excellent high temperature hardness, then the hard coating layer consisting of a laminating layer could have both excellent high temperature strength and excellent high temperature hardness to inhibit excessive wear.

(C) When the $Al_2O_3$ layer which has mainly a κ-type crystal structure (hereinafter referred to as κ-$Al_2O_3$) is formed by chemical vapor deposition at a middle temperature such as 750–850° C., the produced κ-$Al_2O_3$ layer has extremely high hardness at high temperature, so the hard coating layer which has the above-mentioned κ-$Al_2O_3$ layer as an outer layer possesses further excellent high temperature strength and hardness. Therefore, the coated cutting tool having this structure has a superior cutting performance.

Based on these results, the present invention provides for a coated cutting tool which is formed by the hard coating layers consisting of the following features (a) and (b), and can demonstrate excellent wear resistance even in high-speed cutting:

(a) The hard coating layer, as the inner layer, having an average thickness of 0.5–10 μm and residual compressive stress; and (b) the $Al_2O_3$ layer, as the outer layer, having an average thickness of 0.1–5 μm, and being formed by chemical vapor deposition at a middle temperature.

The reason for limiting the average thickness of the above-mentioned inner layer of the hard coating layer to 0.1–10 μm is the following: When the average thickness is less than desired, high wear resistance cannot be given to the hard coating layer, so that the wear progress on the cutting edge is severe. On the other hand, when the average thickness is more than 10 μm, it becomes easy to cause chipping at the cutting edge. However, in the tools with comparatively high strength for the cutting edge such as an insert, it is preferable to limit the average thickness to 0.5–10 μm; on the other hand, in the tools where the cutting edges receive especially severe impacts, like an end mill, it is preferable to limit the average thickness to 0.1–3 μm.

Moreover, the reason for limiting the average thickness of the $Al_2O_3$ layer composing the outer layer to 0.1–5 μm is following: When the thickness is less than 0.1 μm, the desired hardness at high temperature cannot be given to the hard coating layer, so that the desired enhancement effect to the wear resistance of the cutting edge is not obtained. On the other hand, when the thickness is more than 5 μm, it becomes easy to cause breaking or chipping at the cutting edge. However, in the tools where the cutting edges receive especially severe impacts, like an end mill, it is preferable to limit the average thickness to 0.1–3 μm.

EXAMPLES

Having generally described this invention, a further understanding can be obtained by reference to certain specific examples which are provided herein for purposes of illustration only and are not intended to be limiting unless otherwise specified.

Example 1

As a raw material powder, middle coarse grain WC powder having 5.5 μm for the average particle diameter, fine WC powder having 2.3 μm for the average particle diameter, TaC powder having 1.3 μm for the average particle diameter, TiC powder having 1.3 μm for the average particle diameter, TaC powder having 1.3 μm for the average particle diameter, NbC powder having 1.2 μm for the average particle diameter, (Ta, Nb)C (it is TaC/NbC=50/50 by mass ratio) powder having 1.0 μm for the average particle diameter, (Ti, W)C (it is TiC/WC=70/30 by mass ratio) powder having 1.0 μm for the average particle diameter, Ca powder having 1.8 μm for the average particle diameter, are prepared, and these raw material powders are blended with the formulation composition shown in Table 1 respectively.

Furthermore, a wax is added and mixed in acetone for 24 hours by ball milling, and after milling, the mixed powder was dried under a reduced pressure and pressed to the green compact of a predetermined configuration by 1 MPa. Further, these green compacts are heated up to the predetermined temperature in the range of 1370 to 1470° C. by a programming rate of 7° C./minute, under 6 Pa of vacuum, and kept for 1 hour to perform sintering. After that, they are cooled in the condition of a furnace cooling, and further, the honing of R:0.05 is given to the part of the cutting edge. Then the substrates made from the WC base cemented carbide A1~A12 having CNMG120408 for the insert configuration of an ISO specification, were made respectively.

Next, these substrates A1–A12 are cleaned ultrasonically in acetone, and charged respectively into the conventional arc ion plating equipment shown in FIG. 1. On the other hand, the Ti—Al alloys having venous compositions are set as the cathode electrode (evaporation source), and the inside of the equipment is evacuated to keep 0.5 Pa and heated to 500° C. by the heater. Then, Ar is introduced in the equipment to 10 Pa. The bias potential of −800V is applied to the substrate in this state, and the surface of the substrate is cleaned by Ar bombardment. Next, while introducing nitrogen gas as reaction gas in the system and setting to 6 Pa of reaction pressure, the bias potential applied to the above-mentioned substrate is lowered to −200V, and the arc discharge is generated between the above-mentioned cathode electrode and the anode electrode. Then, the designated composition (X value) with the thickness of the (Ti, Al) N layer, which are shown in Table 2, is formed as the inner layer of the hard coating layer.

Furthermore, the κ-$Al_2O_3$ layer with the designated thickness shown in Table 2 similarly, is formed as the outer layer on the surface of the above-mentioned inner layer, by using the conventional chemical vapor deposition equipment in the following conditions.

The reaction gas composition is set to the conventional reaction gas composition, i.e., $AlCl_3$ is 2% by volume, $CO_2$ is 3% by volume, $H_2S$ is 0.3% by volume, HCl is 1% by volume, and $H_2$ is residual.

Figure 2A:
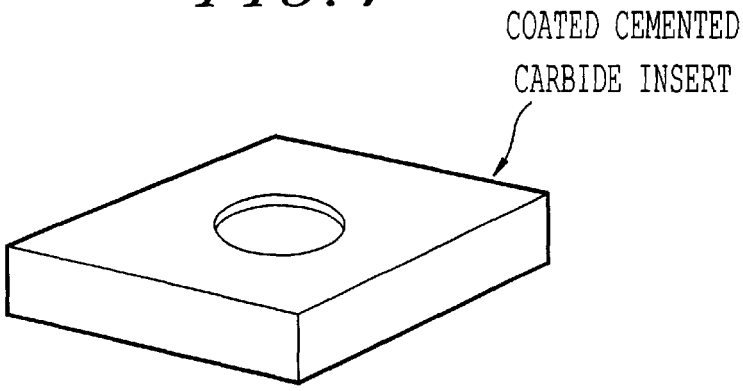
FIG. 2 shows a perspective diagram of a coated insert (a), and a cross-sectional view of the coated insert (b)
Figure 2B:
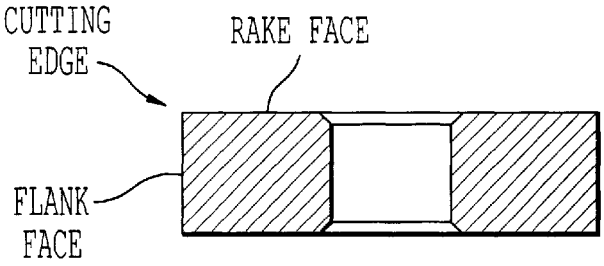

The reaction pressure is also the same value as the conventional condition, i.e., 7 KPa, but the reaction temperature is set to the middle temperature for chemical vapor deposition conditions, i.e., the reaction temperature is 800° C., which is considerably lower in comparison with 1000–1050° C. for the conventional reaction temperature. Then, the coated and cemented carbide inserts 1 to 12 of this invention were made respectively, in which their structures are shown in FIG. 2(*a*) as the rough perspective view and in FIG. 2(*b*) as the rough cross sectional view.

Moreover, for the comparative objective, the conventional coated and cemented carbide inserts 1–12 were made, which consist only of the (Ti, Al)N-layer as the inner layer in the same conditions, excepting to form the κ-$Al_2O_3$ layer by the above-mentioned middle temperature chemical vapor deposition, as shown in Table 3.

In addition, for the hard coating layers of the coated and cemented carbide inserts 1–12 of this invention and the conventional coated and cemented carbide inserts 1–12, the compositions of the center area in the thickness direction of the inner layers were measured by using Auger Electron Spectral analysis equipment, and cross sectional measurements of the thickness were done by using a scanning electron microscope. Then, both of them were indicated with the same values substantially as the designated composition and thickness.

Next, for the above-mentioned coated and cemented carbide inserts of this invention 1–12 and the conventional coated and cemented carbide inserts 1–12, the cutting performance tests were done by screw setting these inserts at the top of the bite holder made of a tool steel.

(1-1) Cutting Style: High-speed Continuous Turning of Alloyed Steel

Work material: Round bar of JIS-SCM440

Cutting speed: 375 m/min.

Depth of cut: 1.5 mm.

Feed rate: 0.2 mm/rev.

Cutting time: 5 min.

Coolant: Dry (1-2) Cutting Style: High-speed Continuous Turning of Cast Iron

Work material: Round bar of JIS-FC250

Cutting speed: 405 m/min.

Depth of cut: 1.5 mm.

Feed rate: 0.3 mm/rev.

Cutting time: 10 min.

Coolant: Dry

The flank wear of the cutting edge was measured in both tests. These measurement results are shown in Tables 2 and 3, respectively.

Example 2

As a raw material powder, middle grain WC powder having 3.0 μm for the average particle diameter, TiC powder having 1.5 μm for the average particle diameter, (Ti, W)C (TiC/WC=70/30 by mass ratio) powder having 1.0 μm for the average particle diameter, (Ta, Nb)C (TaC/NbC=50/50 by mass ratio) powder having 1.0 μm for the average particle diameter, Co powder having 1.8 μm for the average particle diameter, were prepared, and these raw material powders were blended with the composition shown in Table 4 respectively. Furthermore, the wax was added and mixed in acetone for 24 hours by ball milling, and after mixing, the mixed powder was dried under the reduced pressure and pressed to the green compact of the predetermined configuration by 1 MPa. After that, these green compacts were sintered and were heated up to a predetermined temperature in the range of 1370 to 1470° C. by a programming rate of 7° C./minute, under 6 Pa of vacuum, kept for 1 hour, and cooled in the furnace. After sintering, the honing of R:0.05 was given to the part of the cutting edge. Then the substrates made with WC-based cemented carbide A13~A18 having CNMG120408 as the insert configuration of an ISO specification, were made respectively.

Moreover, TiCN (TiC/TiN=50/50 by weight ratio) powder, $Mo_2C$ powder, ZrC powder, NbC powder, TaC powder, WC powder, Co powder, and Ni powder, were used as the raw material powder, in which all of said powders have 0/5–2 μm for the average grain size, and these raw material powders were blended with the compositions shown in Table 5. Wet blending was done by ball milling for 24 hours, and after drying, press forming was done to the green compact by the pressure of 100 MPa. After that, this green compact was sintered for 1 hour by keeping it at the temperature of 1500° C. under 2 kPa of nitrogen atmosphere. Furthermore, after sintering, the honing of R0.05 was given to the part of the cutting edge. Then, the substrates B1–B6 made with TiCN base cermets having CNMG120408 as the insert configuration of an ISO specification were made respectively.

Next, these substrate A13–18 and B1–B6 were washed by ultrasonic waves in acetone, and were charged respectively in the conventional arc ion plating equipment shown in FIG. 1, after being dried. Then, the hard coatings, in which various residual compression stresses were given, were deposited as the inner layer on the surface of the substrates A13 to A18 and B1 to B6, to which bias potential was applied by generating the arc discharge between the evaporation source (cathode electrode) having the various compositions shown in Table 7 and the anode electrode, in the same method as Example 1. Furthermore, $Al_2O_3$ layers having the designated thickness shown in Table 7 were coated on the above-mentioned inner layers as the outer layers were under the conditions shown in Table 6 by using the conventional chemical vapor deposition equipment. Then, the coated and cemented carbide inserts of this invention were made, and the structures of these coated and cemented carbide inserts are shown in FIG. 2(*a*) which is the rough perspective view and in FIG. 2(*b*) which is the rough cross-sectional view. These views are the same as Example 1.

Moreover, for the comparative objective, the conventional coated and cemented carbide inserts 13–24, in which the hard coating layer comprised only the inner layer, were made respectively under the same conditions excepting the formation of $Al_2O_3$ layers by the above-mentioned middle temperature chemical-vapor-deposition process, as shown in Table 8.

In addition, for the hard coating layer of coated and cemented carbide inserts of this invention 13 to 24 and the conventional coated and cemented carbide inserts 13 to 24, the compositions of the center area in the thickness direction of the inner layers were measured by using Auger Electron Spectral analysis equipment, and cross-sectional measurements of the thickness were done by using the scanning electron microscope. Then, both of them were indicated as having the same values substantially as the designated composition and thickness.

Next, for the above-mentioned coated and cemented carbide inserts of this invention 13 to 24 and the conventional coated and cemented carbide inserts 13 to 24, the cutting performance tests were done under the following conditions by screw setting these inserts at the top of the bite holder made with a tool steel.

(2-1) Cutting Style: High-speed Continuous Turning of Alloyed Steel

Work material: Round bar of JIS-SCM440

Cutting speed: 400 m/min.

Depth of cut: 1.5 mm.

Feed rate: 0.2 mm/rev.

Cutting time: 3 min.

Coolant: Dry (2-2) Cutting Style: High-speed Continuous Turning of Cast Iron

Work material: round bar of JIS-FC250

Cutting speed: 450 m/min.,

Depth of cut: 1.5 mm,

Feed rate: 0.3 mm/rev.,

Cutting time: 5 minutes.

These measurement results are shown in Tables 7 and 8, respectively.

Example 3

As the raw material powder, Coarse grain WC powder having 5.5 μm for the average particle diameter, Granular WC powder having 0.8 μm for the average particle diameter, $Cr_3C_2$ powder having 2.3 μm for the average particle diameter, VC powder having 1.2 μm for the average particle diameter, TIC powder having 1.5 μm for the average particle diameter, TaC powder having 1.3 μm for the average particle diameter, NbC powder having 1.2 μm for the average particle diameter, (Ta, Nb)C [TaC/NbC=50/50 by mass ratio] powder having 1.0 μm for the average particle diameter, (Ti, W)C [TiC/WC=70/30 by mass ratio] powder having 1.0 μm for the average particle diameter, and Co powder having 1.8 μm for the average particle diameter, were prepared and these raw material powders were blended with the composition shown in Table 9, respectively. Furthermore, wax was added and mixed in acetone for 24 hours by ball milling, and after mixing, the mixed powder was dried under the reduced pressure and pressed to the green compact of the predetermined configuration by 100 MPa. After that, these green compacts were sintered and heated up to the predetermined temperature in the range of 1370 to 1470° C. by a programming rate of 7° C./minute, under 6 Pa of vacuum, kept for 1 hour, and cooled in the furnace. Then, three sorts of round bar cemented carbide bodies were formed, in which the diameters were 8 mm, 13 mm, and 26 mm. Furthermore, the cemented-carbide end mills a to 1 were made respectively from the above-mentioned three sorts of round-bar bodies by the grinding process in which the dimensions of diameter×length of the cutting edge are ϕ6 mm×13 mm, ϕ10 mm×22 mm, and ϕ20 mm×45 mm shown in Table 9.

Figure 3A:
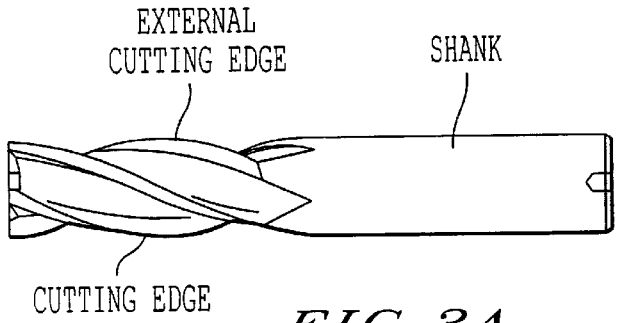
FIG. 3 shows a side view of a coated end mill (a), and a cross-sectional view of the coated end mill (b)
Figure 3B:
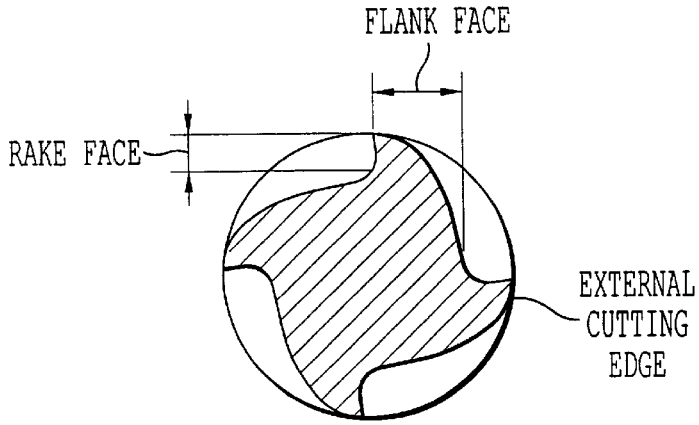

Next, honing was done to these cemented-carbide end mills a to 1, and these end mills were washed by ultrasonic waves in acetone, and were charged respectively in the conventional arc ion plating equipment shown in FIG. 1, after being dried. Moreover, (Ti, Al)N layers of the objective composition (X value) and the objective thickness shown in Table X, were deposited as the inner layer of the hard coating layer on each surface of the cemented-carbide end mill a to 1 to which bias potential was applied by generating the arc discharge between the cathode electrode (evaporation source) equipped with the Ti—Al alloy having the various compositions, and anode electrodes, in the same method as example 1. Furthermore, the κ-$Al_2O_3$ layer having the objective thickness shown in Table 9 was coated on the above-mentioned inner layer as the outer layer by using the conventional chemical vapor deposition equipment. Then, the coated end mills of this invention 1–12 were made respectively, and the structure of these end mills is shown in FIG. 3(*a*) as a side view and in FIG. 3(*b*) as a cross-sectional view.

Moreover, for the comparative objective, the conventional coated end mills 1 to 12, in which the hard coating layer comprised only a (Ti, Al) N layer which is the inner layer, were made respectively under the same conditions excepting the formation of the κ-$Al_2O_3$ layer by the above-mentioned middle temperature chemical vapor deposition process, as shown in Table 11. In addition, for the coating layer of the coated end mills 1 to 12 of this invention and the conventional coated end mills 1 to 12, the compositions of the center area in the thickness direction of the individual layers were measured by using Auger Electron Spectral analysis equipment, and cross-sectional measurements of the thickness were done by using the scanning electron microscope. Then, both of them were indicated with the same values substantially as the designated composition and thickness.

Next, for the coated end mills of this invention 1 to 4 and the conventional coated end mills 1 to 4, the cutting performance tests were done under the following conditions:

(3-1) Cutting style: High-speed Groove Milling on Alloyed Steel

Work material: 100 mm×250 mm, thickness: 50 mm, JIS-NAK square plate

Rotational speed: 7000 r.p.m.

Depth of cut: 3 mm

Table feed rate: 500 mm/min.

Coolant: Water-soluble coolant.

For the coated end mills of this invention 5 to 8 and the conventional coated end mills 5 to 8, the cutting performance tests were done under the following conditions:

(3-2) Cutting Style: High-speed Groove Milling on alloyed Steel

Work material: 100 mm×250 mm, thickness: 50 mm, JIS-SCM 440 square plate

Rotational speed: 6000 r.p.m.

Depth of cut: 5 mm

Table feed rate: 700 mm/min.

Coolant: Water-soluble coolant.

For the coated end mills of this invention 9 to 12 and the coated end mills of the conventional 9 to 12, the cutting performance tests were done under the following conditions:

(3-3) Cutting Style: High-speed Groove Milling on Cast Iron

Work material: 100 mm×250 mm, thickness: 50 mm, JIS-FC250 square plate

Rotational speed: 5000 r.p.m.

Depth of cut: 10 mm

Table feed rate: 3000 mm/min.

Coolant: Water-soluble coolant.

In all wet high-speed groove cutting tests, the cut length was measured; when the nose diameter of the cutting edge reduces by 0.2 mm, this is the end of the usual tool life. These measurement results are shown in Tables 10 and 11, respectively.

Example 4

As the raw material powder, Coarse grain WC powder having 5.5 μm for average particle diameter, granular WC powder having 0.5 mm for average particle diameter, $Cr_3C_2$ powder having 2.3 μm for average particle diameter, TiC powder having 1.5 μm for average particle diameter, TaC powder having 1.3 μm for average particle diameter, NbC powder having 10 μm for average particle diameter, (Ta, Nb)C [TaC/NbC=50/50 by mass ratio] powder having 1.0 μm for average particle diameter, (Ti, W) C[TiC/WC=70/30 by mass ratio] powder having 1.0 μm for average particle diameter, and Co powder having 1.8 μm for average particle diameter, were prepared and these raw material powders were blended with the composition shown in Table 12, respectively. Furthermore, wax was added and mixed in acetone for 24 hours by ball milling, and after mixing, the mixed powder was dried under the reduced pressure and pressed into the green compact of the predetermined configuration by 100 MPa. After that, these green compacts were sintered in a process in which they were heated up to the predetermined temperature in the range of 1370–1470° C. by a programming rate of 7° C./minute, under 6 Pa vacuum, kept for 1 hour, and cooled in the furnace. Then, three sorts of round bar sintered bodies were formed with the diameters being 8 mm, 13 mm, and 26 mm, respectively. Furthermore, cemented carbide drills a' to 1' were made respectively from three sorts of the above-mentioned round-bar bodies by the grinding process in which the diameter× length of the edge formation section is ϕ6 mm×13 mm, ϕ10 mm×22 mm, and ϕ20 mm×45 mm, respectively shown in Table 7.

Figure 4A:
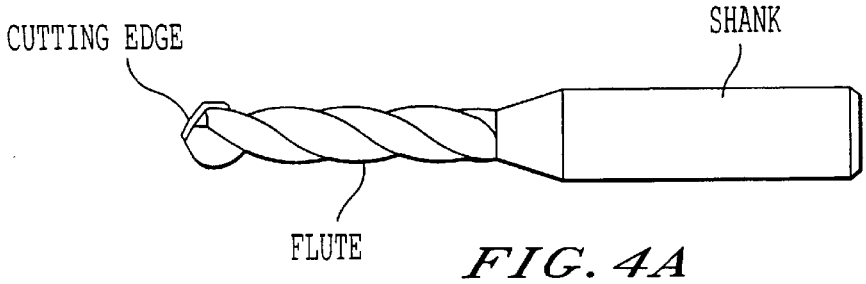
FIG. 4 shows a side view of a coated drill (a), and a cross-sectional view of the coated drill (b).
Figure 4B:
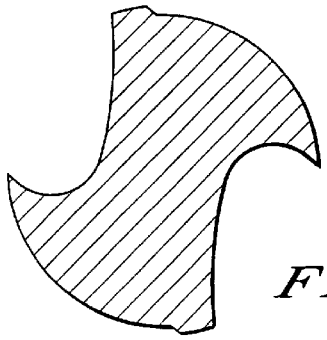

Next, honing was done to these cemented carbide drills a' to 1'. These drills were then washed by ultrasonic waves in acetone and were charged respectively in the conventional arc ion plating equipment shown in FIG. 1, after being dried. Moreover, (Ti, Al)N layers of the objective composition (X value) with the objective thickness were deposited as the inner layer on the surface of the cemented carbide drills a' to 1' to which bias voltage was applied by generating the arc discharge between the cathode electrode (evaporation source) equipped with the Ti—Al alloy having the various compositions and the anode electrode, in the same method as example 1. Furthermore, the κ-$Al_2O_3$ layer having the objective thickness shown in Table 12, was coated on the above-mentioned inner layer as the outer layer by using conventional chemical vapor deposition equipment. Then, the coated drills of this invention were made respectively. The structure of these drills is shown in FIG. 4(*a*) which is the side view and in FIG. 4(*b*) which is the cross-sectional view.

Moreover, for the comparative objective, the conventional coated drills 1–12, in which the hard coating layer comprised only the (Ti, Al)N layer which is the inner layer, were made respectively under the same conditions excepting the formation of the κ-$Al_2O_3$ layer, by the above-mentioned middle temperature chemical vapor deposition process, as shown in Table 14.

In addition, for the hard coating layer of the coated drills of this invention 1–12 and the coated drills of conventional 1–12, the compositions of the center area in the thickness direction of the individual layers were measured by using Auger Electron Spectral analysis equipment and cross-sectional measurements of the thickness were done by using the scanning electron microscope. Then, both of them were indicated with the same values substantially as the designated composition and thickness.

Next, for the coated drills of this invention 1 to 4 and the coated drills of conventional 1 to 4, the cutting performance tests were done under the following conditions:

(4-1) Cutting Style: Drilling on Alloyed Steel

Work material: 100 mm×250 mm, thickness: 50 mm, JIS-SCM440 square plate

Rotational speed: 1000 r.p.m.

Feed rate: 4.25 mm/rev.

Coolant: Water-soluble coolant.

For the coated drills of this invention 5 to 8 and the coated drills of conventional 5 to 8, the cutting performance tests were done under the following conditions:

(4-2) Cutting Style: Drilling on Cast Iron

Work material: 100 mm×250 mm, thickness: 50 mm, JIS-FC200 square plate

Rotational speed: 7500 r.p.m.

Feed rate: 0.30 mm/rev.

Coolant: Water-soluble coolant.

For the coated drills of this invention 9 to 12 and the coated drills of conventional 9 to 12, the cutting performance tests were done under the following conditions:

(4-3) Cutting Style: Drilling on alloyed Steel

Work material: 100 mm×250 mm, thickness: 50 mm, JIS-SCM440 square plate

Rotational speed: 3500 r.p.m.

Feed rate: 0.35 mm/rev.

Coolant: Water-soluble coolant.

In all wet high-speed drilling tests, the numbers of drilled holes were measured when the flank wear width of the cutting edge came down to 0.3 mm. These measurement results are shown in Tables 13 and 14, respectively.

Obviously, numerous modifications and variations of the present invention are possible in light of the above teachings. It is therefore to be understood that, within the scope of the appended claims, the invention may be practiced otherwise than as specifically described herein.

TABLE 1

| Carbide | Composition (wt %) | | | | | | | |
|---|---|---|---|---|---|---|---|---|
| substrate for insert | Co | Cr3C2 | TiC | TaC | NbC | (Ta, Nb)C | (Ti, W)C | WC |
| A1 | 10 | 0.7 | — | — | — | — | — | Fine: Balance |
| A2 | 12 | 1 | — | — | — | — | — | Fine: Balance |

TABLE 1-continued

| Carbide substrate for insert | Composition (wt %) Co | Cr3C2 | TiC | TaC | NbC | (Ta, Nb)C | (Ti, W)C | WC |
|---|---|---|---|---|---|---|---|---|
| A3 | 5 | 0.3 | — | — | — | — | — | Fine: Balance |
| A4 | 6 | 0.1 | — | — | — | 1 | — | Fine: Balance |
| A5 | 8 | 0.7 | — | 1 | — | — | — | Fine: Balance |
| A6 | 5 | 0.1 | 4 | 4 | 4 | — | — | Coarse: Balance |
| A7 | 6 | 0.2 | 5 | — | — | 5 | 5 | Coarse: Balance |
| A8 | 7 | 0.3 | 6 | 9 | 1 | — | 3 | Coarse: Balance |
| A9 | 8 | 0.5 | 12 | 5 | — | 6 | — | Coarse: Balance |
| A10 | 9 | 0.1 | — | — | — | 12 | 8 | Coarse: Balance |
| A11 | 10 | 1 | 5 | — | — | 5 | 10 | Coarse: Balance |
| A12 | 12 | 2 | 7 | 4.5 | 4.5 | 1 | 8 | Coarse: Balance |

TABLE 2

| | | Hard coating layer: Inner layer $(Ti_{1-x}Al_x)N$ | | Outer layer (κ-Al203) | Flank wear at continuous turning (mm) | |
|---|---|---|---|---|---|---|
| Insert | Sub-strate | designed X value (atomic ratio) | designed thickness (μm) | designed thickness (μm) | alloyed steel | cast iron |
| This invention | | | | | | |
| 1 | A1 | 0.2 | 5 | 2 | 0.24 | 0.18 |
| 2 | A2 | 0.5 | 10 | 5 | 0.22 | 0.19 |
| 3 | A3 | 0.4 | 3 | 4 | 0.23 | 0.20 |
| 4 | A4 | 0.3 | 7 | 2 | 0.20 | 0.21 |
| 5 | A5 | 0.4 | 7 | 3 | 0.26 | 0.22 |
| 6 | A6 | 0.5 | 0.5 | 5 | 0.28 | 0.18 |
| 7 | A7 | 0.5 | 10 | 0.1 | 0.21 | 0.28 |
| 8 | A8 | 0.6 | 6 | 4 | 0.20 | 0.22 |
| 9 | A9 | 0.4 | 3 | 2 | 0.21 | 0.24 |
| 10 | A10 | 0.5 | 5 | 2 | 0.23 | 0.25 |
| 11 | A11 | 0.2 | 4 | 5 | 0.25 | 0.19 |
| 12 | A12 | 0.5 | 8 | 4 | 0.24 | 0.22 |

TABLE 3

| | | Hard coating layer: Inner layer $(Ti_{1-x}Al_x)N$ | | Outer layer | Flank wear at continuous turning (mm) | |
|---|---|---|---|---|---|---|
| Insert | Sub-strate | designed X value (atomic ratio) | designed thickness (μm) | (κ-Al203) designed thickness (μm) | alloyed steel | cast iron |
| Conventional | | | | | | |
| 1 | A1 | 0.2 | 5 | — | 0.75 | 0.72 |
| 2 | A2 | 0.5 | 10 | — | 0.58 | 0.59 |

TABLE 3-continued

| | | Hard coating layer: Inner layer $(Ti_{1-x}Al_x)N$ | | Outer layer | Flank wear at continuous turning (mm) | |
|---|---|---|---|---|---|---|
| Insert | Sub-strate | designed X value (atomic ratio) | designed thickness (μm) | (κ-Al203) designed thickness (μm) | alloyed steel | cast iron |
| 3 | A3 | 0.4 | 3 | — | 0.84 | 0.84 |
| 4 | A4 | 0.3 | 7 | — | 0.66 | 0.60 |
| 5 | A5 | 0.4 | 7 | — | 0.65 | 0.61 |
| 6 | A6 | 0.5 | 0.5 | — | 1.15 | 1.21 |
| 7 | A7 | 0.5 | 10 | — | 0.55 | 0.57 |
| 8 | A8 | 0.6 | 6 | — | 0.68 | 0.72 |
| 9 | A9 | 0.4 | 3 | — | 0.83 | 0.89 |
| 10 | A10 | 0.5 | 5 | — | 0.75 | 0.78 |
| 11 | A11 | 0.2 | 4 | — | 0.80 | 0.84 |
| 12 | A12 | 0.5 | 8 | — | 0.61 | 0.65 |

TABLE 4

| Carbide substrate for insert | Composition (wt %) Co | TiC | (Ti, W)C | (Ta, Nb)C | WC |
|---|---|---|---|---|---|
| A13 | 6 | — | — | 1.5 | Balance |
| A14 | 6 | — | 8.5 | 3 | Balance |
| A15 | 7 | 3.5 | 5.5 | 4 | Balance |
| A16 | 8 | 4 | 4 | 5 | Balance |
| A17 | 9 | 21 | — | 2 | Balance |
| A18 | 10 | — | — | 2 | Balance |

TABLE 5

| Carbide substrate for insert | Composition (wt %) Co | Ni | ZrC | TaC | NbC | Mo2C | WC | TiCN |
|---|---|---|---|---|---|---|---|---|
| B1 | 13 | 5 | — | 10 | — | 10 | 16 | Balance |
| B2 | 8 | 1 | — | 5 | — | 7.5 | — | Balance |
| B3 | 5 | — | — | — | — | 6 | 10 | Balance |
| B4 | 10 | 5 | — | 11 | 2 | — | — | Balance |
| B5 | 9 | 4 | 1 | 8 | — | 10 | 10 | Balance |
| B6 | 12 | 5.5 | — | 10 | — | 9.5 | 14.5 | Balance |

TABLE 6

| | Coating Condition | | |
|---|---|---|---|
| | | Ambience | |
| Hard Coating Layer | Composition of reactive gas (volume %) | Pressure K(Pa) | Temperature (° C.) |
| κ-$Al_2O_3$ ① | $AlCl_3$: 2%, $CO_2$: 3%, HCl: 1%, $H_2S$: 0.3%, $H_2$: Residue | 7 | 800 |
| κ-$Al_2O_3$ ② | $AlCl_3$: 2%, $CO_2$: 2%, HCl: 1.5%, $H_2S$: 0.4%, $H_2$: Residue | 7 | 750 |

TABLE 6-continued

| Hard Coating Layer | Coating Condition: Composition of reactive gas (volume %) | Ambience: Pressure K(Pa) | Ambience: Temperature (° C.) |
|---|---|---|---|
| $\alpha$-$Al_2O_3$ ① | $AlCl_3$: 1%, $CO_2$: 10%, HCl: 1%, $H_2S$: 0.1%, $H_2$: Residue | 7 | 850 |
| $\alpha$-$Al_2O_3$ ② | $AlCl_3$: 1%, $CO_2$: 15%, HCl: 1.5%, $H_2S$: 0.1%, $H_2$: Residue | 7 | 850 |

TABLE 7

| Insert | Substrate | Hard coating layer (Figure in parenthesis means designed thickness: $\mu$m): Inner layer: Target composition | Inner layer: Layer | Outer layer | Flank wear at continuous turning (mm): alloyed steel | cast iron |
|---|---|---|---|---|---|---|
| This invention | | | | | | |
| 1 | A13 | Ti 100% | TiN (3.5) | κ-Al2O3 ① (1) | 0.22 | 0. 32 |
| 2 | A14 | Ti 100% | TiCN (5) | κ-Al2O3 ① (2) | 0.25 | 0.35 |
| 3 | A15 | Cr 100% | CrN (7) | κ-Al2O3 ① (2) | 0.27 | 0.30 |
| 4 | A16 | Ti 50%/ Al 50% | (TiAl)CN (3) | κ-Al2O3 ① (0.5) | 0.28 | 0.32 |
| 5 | A17 | Ti 60%/ Al 40% | (TiAl)N (5) | κ-Al2O3 ① (5) | 0.30 | 0.33 |
| 6 | A18 | Ti 50%/ Zr 50% | (TiZr)N (5) | κ-Al2O3 ① (1) | 0.28 | 0.36 |
| 7 | B1 | Ti 50%/ V 50% | (TiV)N (10) | κ-Al2O3 ② (2) | 0.31 | 0.30 |
| 8 | B2 | Ti 50%/ Cr 50% | (TiCr)N (4) | κ-Al2O3 ② (1.5) | 0.25 | 0.38 |
| 9 | B3 | Ti 50%/ Si 50% | (TiSi)N (4) | κ-Al2O3 ② (3) | 0.24 | 0.38 |
| 10 | B4 | Ti 40%/ Al 40%/ Zr 20% | (TiAlZr)N (5) | α-Al2O3 ① (2) | 0.29 | 0.35 |
| 11 | B5 | Ti 40%/ Al 40%/ V 20% | (TiAlV)N (6) | α-Al2O3 ② (1) | 0.30 | 0.36 |
| 12 | B6 | Ti 40%/ Al 40%/ Cr 20% | (TiAlCr)N (3) | α-Al2O3 ① (3) | 0.29 | 0.33 |

TABLE 7-continued

| Insert | Substrate | Hard coating layer (Figure in parenthesis means designed thickness: $\mu$m): Inner layer: Target composition | Inner layer: Layer | Outer layer | Flank wear at continuous turning (mm): alloyed steel | cast iron |
|---|---|---|---|---|---|---|
| 13 | A1 | Ti 40%/ Al 40%/ Si 20% | (TiAlSi)N (2) | α-Al2O3 ② (0.5) | 0.29 | 0.34 |
| 14 | A2 | Ti 40%/ Al 40%/ Y 20% | (TiAlY)N (5) | κ-Al2O3 ① (0.5) | 0.33 | 0.31 |
| 15 | A3 | Ti 40%/ Al 40%/ Y 20% | (TiAlY)CN (5) | κ-Al2O3 ② (1) | 0.28 | 0.32 |

TABLE 8

| Insert | Substrate | Hard coating layer (Figure in parenthesis means designed thickness: $\mu$m): Inner layer: Target composition | Inner layer: Layer | Outer layer | Flank wear at continuous turning (mm): alloyed steel | cast iron |
|---|---|---|---|---|---|---|
| Conventional | | | | | | |
| 1 | A13 | Ti 100% | TiN (3.5) | — | 0.77 | 0.92 |
| 2 | A14 | Ti 100% | TICN (5) | — | 0.65 | 0.91 |
| 3 | A15 | Cr 100% | CrN (7) | — | 0.64 | 0.76 |
| 4 | A16 | Ti 50%/ Al 50% | (TiAl)CN (3) | — | 0.81 | 0.90 |
| 5 | A17 | Ti 60%/ Al 40% | (TiAl)N (5) | — | 0.59 | 0.85 |
| 6 | A18 | Ti 50%/ Zr 50% | (TiZr)N (5) | — | 0.70 | 0.81 |
| 7 | B1 | Ti 50%/ V 50% | (TiV)N (10) | — | 0.69 | 0.80 |
| 8 | B2 | Ti 50%/ Cr 50% | (TiCr)N (4) | — | 0.80 | 0.86 |
| 9 | B3 | Ti 50%/ Si 50% | (TiSi)N (4) | — | 0.82 | 1.08 |
| 10 | B4 | Ti 40%/ Al 40%/ Zr 20% | (TiAlZr)N (5) | — | 0.73 | 0.82 |
| 11 | B5 | Ti 40%/ Al 40%/ V 20% | (TiAlV)N (6) | — | 0.74 | 0.79 |
| 12 | B6 | Ti 40%/ Al 40%/ Cr 20% | (TiAlCr)N (3) | — | 0.62 | 1.01 |
| 13 | A1 | Ti 40%/ Al 40%/ Si 20% | (TIAlSi)N (2) | — | 0.64 | 0.95 |
| 14 | A2 | Ti 40%/ Al 40%/ Y 20% | (TiAlY)N (5) | — | 0.70 | 0.95 |
| 15 | A3 | Ti 40%/ Al 40%/ Y 20% | (TiAlY)CN (5) | — | 0.63 | 0.93 |

TABLE 9

| Carbide substrate for End-mill | Composition (wt %) Co | Cr3C2 | VC | TiC | TaC | NbC | (Ta,Nb)C | (Ti,W)C | WC | Size (diameter × length: mm) |
|---|---|---|---|---|---|---|---|---|---|---|
| a | 15 | 0.5 | 2 | — | — | — | — | — | Fine: Balance | ϕ6 × 13 |
| b | 8 | 0.4 | 0.3 | — | — | — | — | — | Fine: Balance | ϕ6 × 13 |
| c | 9 | 0.1 | 0.1 | 9 | — | — | 12 | — | Coarse: Balance | ϕ6 × 13 |
| d | 15 | 2 | 2 | — | 9 | 1 | — | 13 | Coarse: Balance | ϕ6 × 13 |
| e | 10 | 0.5 | 0.4 | — | — | — | — | — | Fine: Balance | ϕ10 × 22 |
| f | 10 | 0.7 | 0.5 | — | — | — | — | — | Fine: Balance | ϕ10 × 22 |
| g | 12 | 0.6 | 0.4 | — | 2 | — | 2 | 2 | Fine: Balance | ϕ10 × 22 |
| h | 13 | 0.1 | 0.1 | — | — | — | 10 | 10 | Coarse: Balance | ϕ10 × 22 |
| i | 7 | 0.3 | 0.2 | — | — | — | — | — | Fine: Balance | ϕ20 × 45 |
| j | 5 | 0.2 | 0.1 | — | — | — | — | — | Fine: Balance | ϕ20 × 45 |
| k | 5 | 0.1 | 0.1 | 3 | 2 | 1 | — | — | Coarse: Balance | ϕ20 × 45 |
| l | 8 | 0.4 | 0.3 | 7 | 4.5 | 0.5 | 5 | 1 | Coarse: Balance | ϕ20 × 45 |

TABLE 10

| | | Hard coating layer | | | |
|---|---|---|---|---|---|
| | | Inner layer $(Ti_{1-x}Al_x)N$ | | Outer layer | |
| End-mill | Sub-strate | designed X value (atomic ratio) | designed thickness (μm) | (κ-Al2O3) designed thickness (μm) (μm) | Cutting length (m) |
| This invention | | | | | |
| 1 | a | 0.2 | 3 | 0.1 | 352 |
| 2 | b | 0.5 | 2 | 0.5 | 500 |
| 3 | c | 0.6 | 1.5 | 1 | 422 |
| 4 | d | 0.4 | 1 | 1 | 404 |

TABLE 10-continued

| | | Hard coating layer | | | |
|---|---|---|---|---|---|
| | | Inner layer $(Ti_{1-x}Al_x)N$ | | Outer layer | |
| End-mill | Sub-strate | designed X value (atomic ratio) | designed thickness (μm) | (κ-Al2O3) designed thickness (μm) (μm) | Cutting length (m) |
| 5 | e | 0.6 | 0.1 | 3 | 206 |
| 6 | f | 0.5 | 1 | 2 | 478 |
| 7 | g | 0.3 | 2 | 1 | 452 |
| 8 | h | 0.6 | 3 | 0.5 | 480 |
| 9 | 1 | 0.6 | 2 | 0.5 | 512 |
| 10 | j | 0.5 | 1.5 | 1 | 497 |
| 11 | k | 0.5 | 1.5 | 1 | 500 |
| 12 | 1 | 0.6 | 2 | 1 | 515 |

TABLE 11

| | | | Hard coating layer | | | |
|---|---|---|---|---|---|---|
| | | | Inner layer $(Ti_{1-x}Al_x)N$ | | Outer layer (κ-A1203) | |
| End-mill | | Substrate | designed X value (atomic ratio) | designed thickness (μm) | designed thickness (μm) | Cutting length (m) |
| Conventional | 1 | a | 0.2 | 3 | — | 82 |
| | 2 | b | 0.5 | 2 | — | 78 |
| | 3 | c | 0.6 | 1.5 | — | 70 |
| | 4 | d | 0.4 | 1 | — | 72 |
| | 5 | e | 0.6 | 0.1 | — | 48 |
| | 6 | f | 0.5 | 1 | — | 62 |
| | 7 | g | 0.3 | 2 | — | 81 |
| | 8 | h | 0.6 | 3 | — | 92 |
| | 9 | i | 0.6 | 2 | — | 83 |
| | 10 | j | 0.5 | 1.5 | — | 77 |
| | 11 | k | 0.5 | 1.5 | — | 64 |
| | 12 | l | 0.6 | 2 | — | 69 |

TABLE 12

| Carbide substrate far drill | Composition (wt %) Co | Cr3C2 | TiC | TaC | NbC | (Ta,Nb)C | (Ti,W)C | WC | Size diameter × length: mm) |
|---|---|---|---|---|---|---|---|---|---|
| a' | 15 | 2 | — | — | — | — | — | Fine: Balance | φ6 × 13 |
| b' | 10 | 0.7 | — | — | — | — | — | Fine: Balance | φ6 × 13 |
| c' | 9 | 0.1 | 8 | — | — | 12 | — | Coarse: Balance | φ6 × 13 |
| d' | 15 | 1.5 | — | 9 | 1 | — | 15 | Coarse: Balance | φ6 × 13 |
| e' | 12 | 1 | — | — | — | — | — | Fine: Balance | φ10 × 22 |
| f' | 10.5 | 0.8 | — | — | — | — | — | Fine: Balance | φ10 × 22 |
| g' | 14 | 1.5 | — | 3 | — | 2 | — | Fine: Balance | φ10 × 22 |
| h' | 10 | 0.1 | — | — | — | 12 | 12 | Coarse: Balance | φ10 × 22 |
| i' | 5 | 0.1 | — | — | — | — | — | Fine: Balance | φ20 × 45 |
| j' | 7 | 0.5 | — | — | — | — | — | Fine: Balance | φ20 × 45 |
| k' | 7 | 0.2 | 4 | 4 | 4 | — | — | Coarse: Balance | φ20 × 45 |
| l' | 10 | 0.1 | 8 | 4.5 | 0.5 | 7 | 5 | Coarse: Balance | φ20 × 45 |

TABLE 13

| | | | Hard coating layer: Inner layer $(Ti_{1-x}Al_x)N$ designed X value (atomic ratio) | designed thickness (μm) | Outer layer (κ-A1203) designed thickness (μm) | |
|---|---|---|---|---|---|---|
| Drill | | Substrate | | | | Number of holes |
| This invention | 1 | a' | 0.2 | 0.5 | 4 | 2000 |
| | 2 | b' | 0.5 | 3 | 2 | 2550 |
| | 3 | c' | 0.4 | 2 | 2 | 2400 |
| | 4 | d' | 0.6 | 4 | 0.5 | 2100 |
| | 5 | e' | 0.3 | 6 | 2 | 2350 |
| | 6 | f' | 0.5 | 10 | 5 | 3000 |
| | 7 | g' | 0.6 | 7 | 1 | 2400 |
| | 8 | h' | 0.2 | 7 | 2 | 2550 |
| | 9 | i' | 0.6 | 10 | 3 | 2950 |
| | 10 | j' | 0.5 | 8 | 4 | 2800 |
| | 11 | k' | 0.4 | 9 | 3 | 2800 |
| | 12 | l' | 0.3 | 7 | 5 | 2400 |

TABLE 14

| | | | Hard coating layer: Inner layer $(Ti_{1-x}Al_x)N$ designed X value (atomic ratio) | designed thickness (μ) | Outer layer (κ-A1203) designed thickness (μ) | |
|---|---|---|---|---|---|---|
| Drill | | Substrate | | | | Number of holes |
| Conventional | 1 | a' | 0.2 | 0.5 | — | 280 |
| | 2 | b' | 0.5 | 3 | — | 550 |
| | 3 | c' | 0.4 | 2 | — | 450 |
| | 4 | d' | 0.6 | 4 | — | 600 |
| | 5 | e' | 0.3 | 6 | — | 400 |
| | 6 | f' | 0.5 | 10 | — | 600 |
| | 7 | g' | 0.6 | 7 | — | 550 |
| | 8 | h' | 0.2 | 7 | — | 500 |
| | 9 | i' | 0.6 | 10 | — | 500 |
| | 10 | j' | 0.5 | 8 | — | 700 |
| | 11 | k' | 0.4 | 9 | — | 650 |
| | 12 | l' | 0.3 | 7 | — | 650 |

What is claimed is:

1. A coated cutting tool, comprising:

a hard sintered substrate; and a hard coating layer deposited on a surface of said substrate;

wherein said hard coating layer comprises a hard material layer as an inner layer having 0.1–10 μm for an average thickness with residual compressive stress, said inner layer being applied by physical vapor deposition, and an aluminum oxide layer as an outer layer having 0.1–5 μm for an average thickness, wherein said outer layer is applied by chemical vapor deposition at a middle temperature.

2. A coated cutting tool according to claim 1, wherein the residual compressive stress of the inner layer is 0.1–3 GPa.

3. A coated cutting tool according to claim 1, wherein the residual compressive stress of the inner layer is 0.2–1.5 GPa.

4. A coated cutting tool according to claim 1, wherein the outer layer is coated at 700–850° C.

5. A coated cutting tool according to claim 1, wherein the aluminum oxide layer mainly has a κ and/or an α crystal structure.

6. A coated cutting tool according to claim 1, wherein the aluminum oxide layer mainly has a γ crystal structure.

7. A coated cutting tool according to claim 1, wherein the aluminum oxide layer mainly has an amorphous structure.

8. A coated cutting tool according to claim 1, wherein the inner layer comprises at least one of a titanium carbide layer, a titanium nitride layer or a titanium carbonitride layer.

9. A coated cutting tool according to claim 1, wherein the inner layer comprises at least one of a chromium nitride layer or a chromium carbonitride layer.

10. A coated cutting tool according to claim 1, wherein the inner layer comprises at least one of a composite nitride of titanium and aluminum, a composite carbonitride of titanium and aluminum, or a combination thereof.

11. A coated cutting tool according to claim 1, wherein the inner layer comprises at least one of a composite nitride of titanium and zirconium, a composite carbonitride of titanium and zirconium, or a combination thereof.

12. A coated cutting tool according to claim 1, wherein the inner layer comprises at least one of a composite nitride of titanium and vanadium, a composite carbonitride of titanium and vanadium, or a combination thereof.

13. A coated cutting tool according to claim 1, wherein the inner layer comprises at least one of a composite nitride of titanium and chromium, a composite carbonitride of titanium and chromium, or a combination thereof.

14. A coated cutting tool according to claim 1, wherein the inner layer comprises at least one of a composite nitride of titanium and silicon, a composite carbonitride of titanium and silicon, or a combination thereof.

15. A coated cutting tool according to claim 1, wherein the inner layer comprises at least one of a composite nitride, a composite carbonitride or a combination thereof, comprising three metals, wherein two of the three metals are titanium and aluminum and one other metal is selected from the group consisting of zirconium, vanadium, chromium, silicon and yttrium.

16. A coated cutting tool according to claim 1, wherein the hard sintered substrate is a cemented carbide comprising tungsten carbide.

17. A coated cutting tool according to claim 1, wherein the hard sintered substrate is a cement comprising titanium carbonitride.

18. A coated cutting tool according to claim 16, wherein the cemented carbide contains 0.1 to 2% by mass of chromium carbide.

19. A coated cutting tool according to claim 16, wherein the cemented carbide contains 0.1 to 2% by mass of chromium carbide and 0.1 to 2% by mass of vanadium carbide.

20. The coated cutting tool of claim 1, wherein the outer layer is applied at 750–850° C.

* * * * *